United States Patent [19]

Hemphill

[11] 4,321,762

[45] Mar. 30, 1982

[54] DIGGING TOOTH APPARATUS FOR V BOTTOM BUCKET

[76] Inventor: Charles W. Hemphill, 800 S. Fifth Ave., Mansfield, Tex. 76063

[21] Appl. No.: 86,017

[22] Filed: Oct. 17, 1979

[51] Int. Cl.[3] ..... E02F 9/28

[52] U.S. Cl. ..... 37/141 R; 37/142 R

[58] Field of Search ..... 37/141 R, 141 T, 142 R, 37/142 A, 115–117

[56] References Cited

U.S. PATENT DOCUMENTS

| | | | |
|---|---|---|---|
| 2,145,663 | 1/1939 | Reynolds | 37/141 T |
| 2,702,698 | 2/1955 | Synder et al. | 37/142 R X |
| 3,774,324 | 11/1973 | LaFond | 37/142 R |
| 4,037,337 | 7/1977 | Hemphill | 37/141 T X |
| 4,098,013 | 7/1978 | Hemphill | 37/142 R |
| 4,117,611 | 10/1978 | Hemphill | 37/142 R |

FOREIGN PATENT DOCUMENTS

| | | | |
|---|---|---|---|
| 2851442 | 6/1979 | Fed. Rep. of Germany | 37/142 R |
| 421899 | 2/1935 | United Kingdom | 37/142 R |
| 1410814 | 10/1975 | United Kingdom | 37/142 A |

*Primary Examiner*—E. H. Eickholt

*Attorney, Agent, or Firm*—Marcus L. Bates

[57] ABSTRACT

A digging tooth and bucket combination. The bucket has a V-shaped leading edge. Digging teeth are arranged vertically spaced from one another on the leading edge to cause the bottom of the excavation to be V shaped, with each side of the V being formed by a plurality of ledges. This causes the bottom of the excavation to have a stair-step configuration. Each digging tooth has a cutting edge arranged thereon to cut away material from a vertical side and a bottom of the ledge as the teeth penetrate the formation. The digging teeth are removably mounted to a shank, while the shank is rigidly attached to the V-shaped bucket lip. Forces imposed on the cutting edge of the teeth are transferred into the shank and then into the bucket lip in an improved manner.

15 Claims, 19 Drawing Figures

DIGGING TOOTH APPARATUS FOR V BOTTOM BUCKET

BACKGROUND OF THE INVENTION

In my previous U.S. Pat. Nos. 4,037,337 and 4,123,861, there is set forth a digging bucket having a V-shaped leading edge which forms the bucket lip. Digging teeth are arranged on the lip whereby opposed outer teeth are positioned above and forwardly of any adjacent, opposed inner teeth. A bucket having this configuration exhibits exceptional digging efficiency; and when the bucket is provided with properly designed teeth, the bucket efficiently cuts in rock-like formation, as well as efficiently handling plastic-like material.

When digging into a rock-like formation with the above described digging bucket, the bottom of the ditch is formed into a V, with each side of the V being a plurality of ledges arranged in stair-step relationship respective to one another. As the ditch is further excavated, each of the digging teeth accordingly must remove material from the bottom and sidewall which forms a ledge, there being no opposite sidewall for the tooth to encounter, except for the lowermost digging tooth, which forms the central portion of the ditch.

It would therefore be desirable to have made available a special digging tooth designed to cut the sidewall and bottom of each of the ledges, with the material being excavated in an efficient manner, and the excavated material being moved inwardly and upwardly following the cutting action of the teeth.

A digging tooth and shank combination for performing such an operation is the subject of this invention.

SUMMARY OF THE INVENTION

Improvements in digging teeth for a V-shaped digging bucket. The teeth are mounted to the V-shaped bucket lip by a special shank which transfers the load imposed upon the tooth into a bucket lip in an improved manner. The teeth are arranged respective to one another to cut a plurality of ledges arranged to form a V-shaped ditch of stair-step configuration.

The digging teeth include a rearwardly directed tang and a forwardly directed digging end, with the digging end of the teeth having opposed sides, a top, and a bottom. The digging end of the tooth is reduced in cross-sectional area in a forward direction by a sloped face which is contoured to provide a cutting edge. The cutting edge extends from one lower side of the tooth to the other side thereof, and upwardly and rearwardly slopes towards the other side of the tooth which is opposite to the cutting edge. This last side is arranged vertically and extends from the bottom to the top of the tooth, and bears against the vertical sidewall of a ledge.

The rear marginal end of the tooth is reduced into a tang, thereby leaving a shoulder between the cutting end of the tooth and the tang.

A tooth-receiving shank has a rear marginal end portion which receives the bucket lip therewithin so that the shank can be rigidly secured to the leading edge of the bucket. The forward marginal end of the shank has a pocket formed therewithin which receives the tang of the tooth in close tolerance relationship therewithin. The forces imposed upon the digging teeth are transferred into the shank by means of the shoulder and tang-receiving pocket.

One embodiment of the shank includes a pocket member having a rearwardly directed ball formed thereon and a socket member having a socket formed therewithin. The ball is received within the socket in close tolerance relationship therewithin; and the pocket member can be axially rotated respective to the socket member, thereby enabling the digging teeth to be rotated about the longitudinal axis thereof for optimum positioning of any tooth so that the tooth is oriented with respect to the bucket lip.

This expedient enables a two-piece shank to be employed for mounting all of the individual teeth to the bucket, so that right and left-hand teeth, which are mirror images of one another, are properly accommodated by the right and left-hand sides of the bucket lip.

A primary object of the present invention is the provision of a digging teeth especially adapted for use in conjunction with a V-shaped bucket.

Another object of the invention is to provide a digging tooth, shank, and bucket combination which digs a V-shaped ditch in an improved manner.

A further object of this invention is to disclose and provide a digging tooth for use in a bucket having a V-shaped lip for excavating rock formations.

A still further object of this invention is to provide an improved shank and tooth combination for a V-shaped bucket which excavates material to form a ditch having a V-shaped bottom with each side of the bottom being a series of adjacent ledges.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
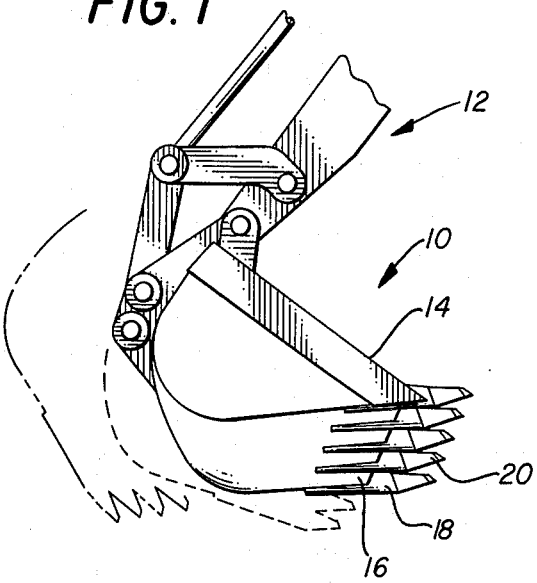
FIG. 1 is a broken, side elevational view of a backhoe bucket having digging teeth and tooth-receiving shanks made in accordance with the present invention.
Figure 3:
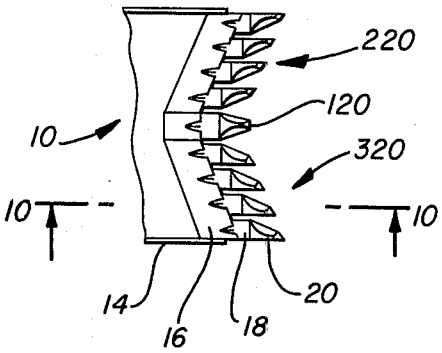
FIG. 3 is a reduced, fragmentary, top plan view of the bucket disclosed in the foregoing figures.
Figure 4:
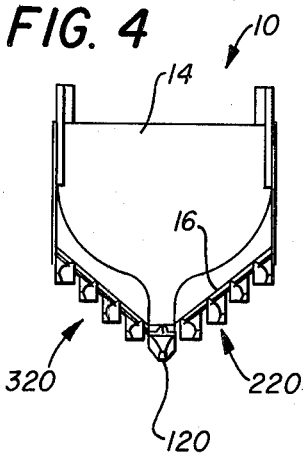
FIG. 4 is a front view of the apparatus disclosed in the foregoing figures.
Figure 2:
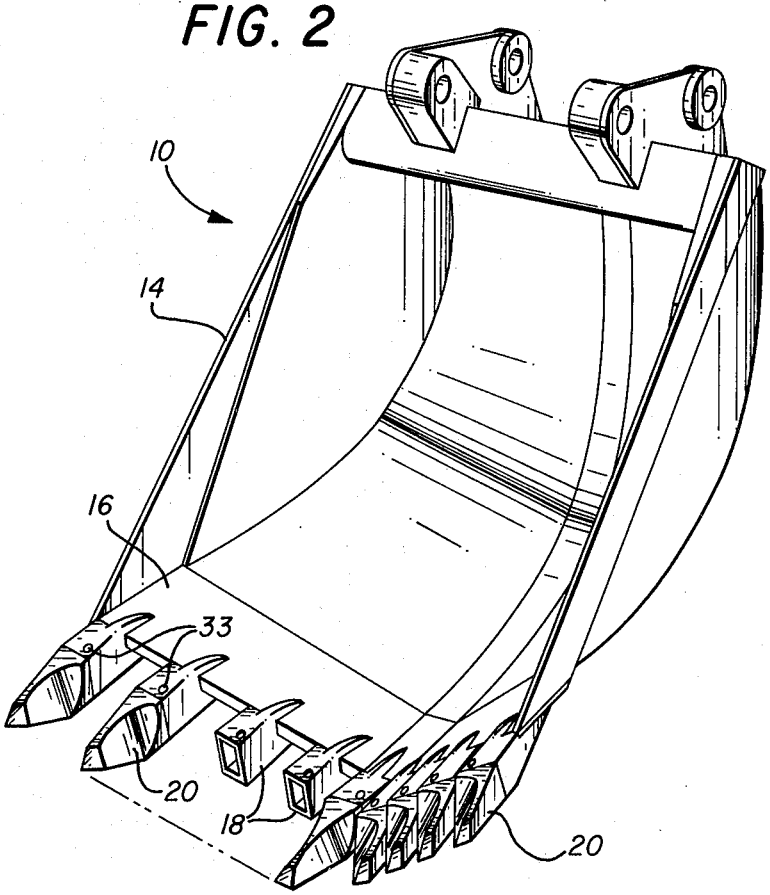
FIG. 2 is an enlarged, perspective view of part of the apparatus disclosed in FIG. 1.
Figure 5:
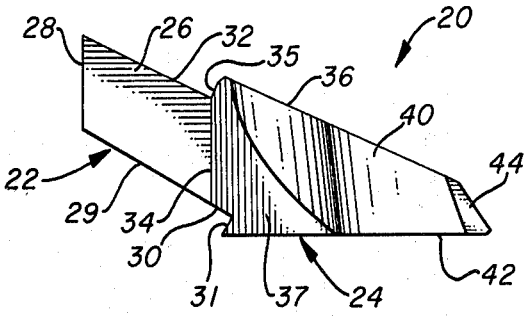
FIG. 5 is an enlarged, side elevational view of one of the teeth seen in the foregoing figures.
Figure 6:
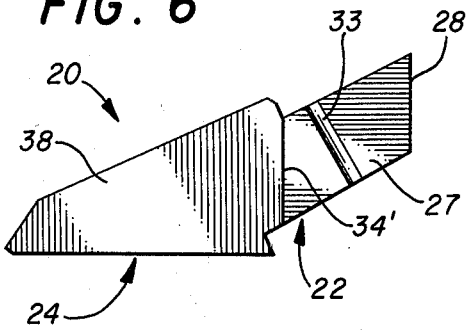
FIG. 6 is an opposite side view of the tooth disclosed in FIG. 5.
Figure 7:
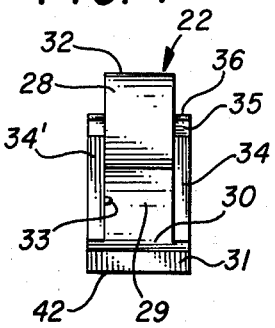
FIG. 7 is a rear view of the tooth disclosed in FIGS. 5 and 6.
Figure 8:
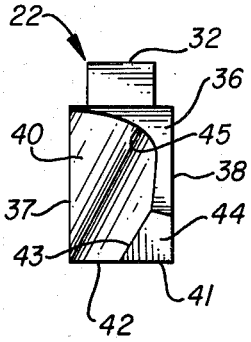
FIG. 8 is a front view of the tooth disclosed in FIGS. 5–7.
Figure 9:
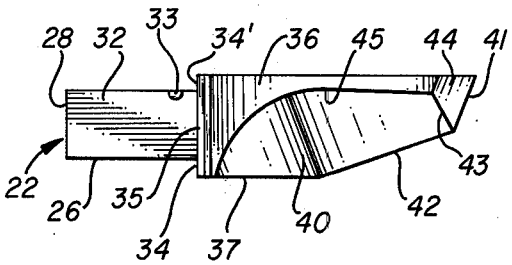
FIG. 9 is a top plan view of the tooth disclosed in FIG. 5.

In FIG. 1, there is disclosed a backhoe bucket and digging tooth combination 10. The bucket 14 is attached to a dipper stick 12 of a backhoe machine (not shown). The bucket has a lip 16 formed at the forward end of the bucket. A plurality of tooth-receiving shanks 18 are rigidly attached to the bucket lip. A tooth 20 is removably received by each of the shanks.

As seen in FIGS. 1–10, and in particular FIGS. 5–10, each of the teeth includes a rear marginal portion 22, hereinafter called a tang, and a forward marginal portion 24, hereinafter called a digging member. The tang has opposed vertical sidewalls 26 and 27, a rear wall 28, and a bottom wall 29 which continues at 30 where the bottom wall terminates at a lower shoulder 31. The tang includes a top wall 32. One sidewall of the tang has a vertical groove 33 formed therein in indexed relationship with an aperture 33′ of the shank, by which the tang of the tooth is locked within the shank, as will be described in greater detail later on in this disclosure.

Opposed vertical shoulders 34, 34′ define the forward end of the tang and the rear end of the digging member. The shoulders upwardly curve at 35 and join an upper wall 36 of the digging member.

The digging member of the tooth includes opposed, vertical sidewalls 37 and 38, which are disclosed as being parallel to one another and arranged in spaced vertical planes, which are parallel to the spaced, vertical sidewalls 26 and 27 of the tang.

One side of the forward marginal portion of the cutting member of the tooth is formed into a sloped face 40. The sloped face forms a curved cutting edge 41 and 42 about the forward end and one side of the cutting member. Cutting edge 43 results from the formation of face 44 which is provided at the forward, marginal, terminal end of the tooth. The sloped face terminates along curved edge portion 45, defined by the intersection of the upper wall 36 and sloped faces 40 and 41.

Figure 10:
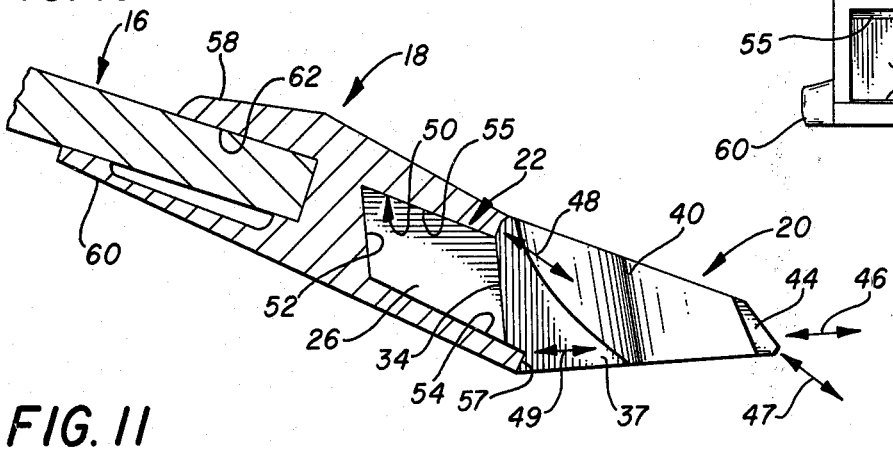
FIG. 10 is an enlarged, fragmentary, part crosssectional view taken along line 10—10 of FIG. 3.
Figure 12:
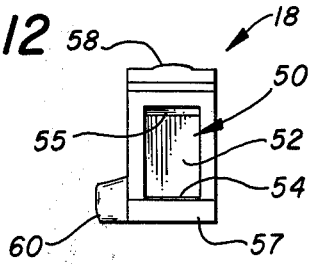
FIG. 12 is a front view of the apparatus disclosed in FIG. 11.
Figure 11:
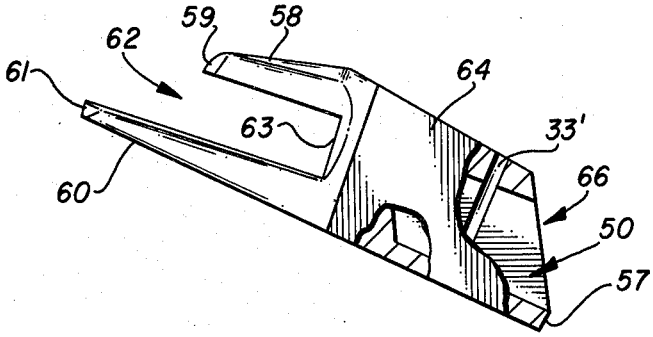
FIG. 11 is an enlarged, part cross-sectional view of part of the apparatus disclosed in FIGS. 1–4.
Figure 14:
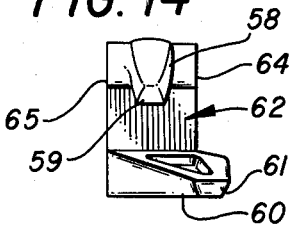
FIG. 14 is a rear view of the apparatus disclosed in FIG. 11.
Figure 13:
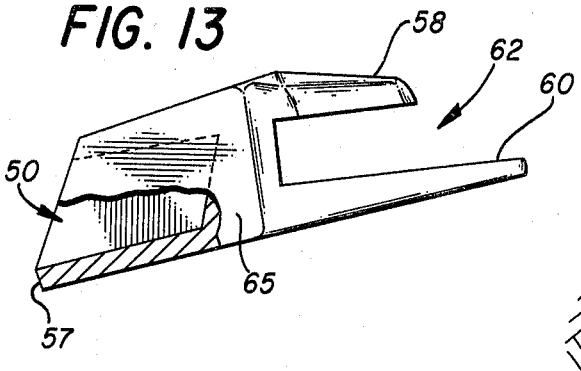
FIG. 13 is an opposite side view of the apparatus disclosed in FIG. 11.

In FIG. 10, there is disclosed the bucket lip 16 in combination with the shank 18 and the tooth 20. Numerals 46, 47, 48, and 49 indicate the resultant forces encountered by the digging member of the tooth and the shank during the excavation of material.

A tooth-receiving pocket 50 is formed within the forward marginal end of the shank. The pocket is in the form of a cavity which is defined by and includes a rear wall 52, floor 54, and roof 55. An entrance into the pocket is defined by a shoulder 57. The shoulder forms the forward terminal end of the shank and extends 360° about the pocket.

As best seen illustrated in FIGS. 10–14, the rear marginal portion of the shank is in the form of an upper ledge 58 having a rear terminal end 59. A lower ledge 60 having a rear terminal end 61 is separated from the upper ledge to provide a lip-receiving gap 62. Wall 63 separates the upper and lower ledges from one another and abuttingly receives the forward terminal end of the lip.

The shank includes opposed sidewalls 64 and 65. The sidewalls are vertical and coincide with the sidewalls of the digging member. Numeral 66 indicates the forward terminal end of the shank, which is defined by the before mentioned shoulder 57.

Figure 15:
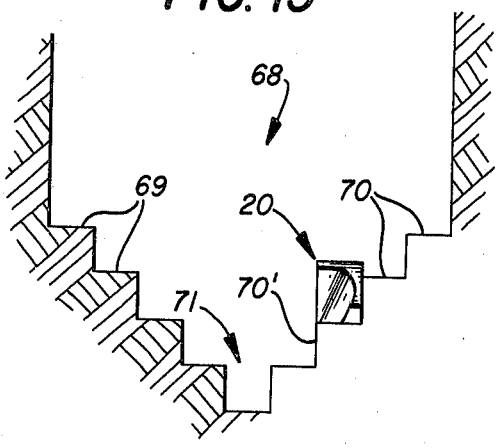
FIG. 15 is a diagrammatical representation of an excavation made with the bucket of FIGS. 1–4.

FIG. 15 diagrammatically illustrates a ditch which has been excavated by the bucket, shank, and digging teeth of the present invention. The ditch 68 has a V-shaped bottom formed of a plurality of ledges 69 on one side thereof and a plurality of ledges 70 located on the other side thereof, with a central trough 71 separating one side of the ditch from the other. The ledges jointly form a stair-step configuration down into the bottom of the ditch. Each of the ledges has a bottom 70 and sidewall 70′.

Figure 16:
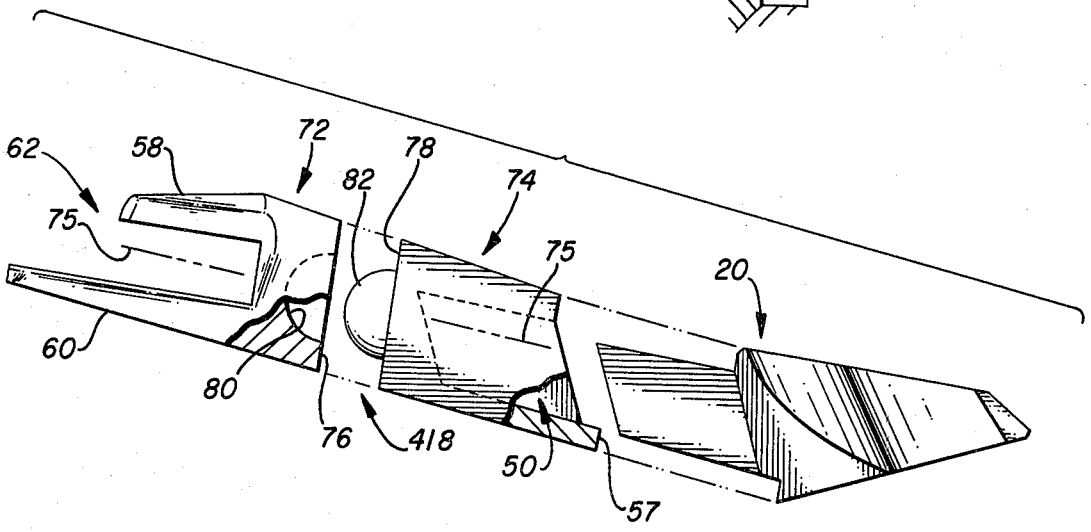
FIG. 16 is an exploded view of a modification of the apparatus disclosed in FIG. 10.
Figure 17:
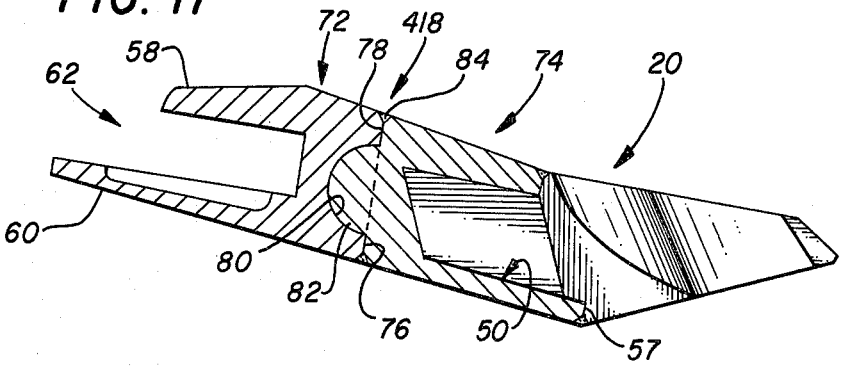
FIG. 17 is an assembled, part cross-sectional view of the apparatus disclosed in FIG. 16.

In FIGS. 16 and 17, there is disclosed an alternant embodiment 418 of a tooth-receiving shank. The shank includes a rear or socket member 72 and a forward or pocket member 74 which are joined together at coacting, vertically disposed surfaces 76 and 78. Member 72 has a socket 80 formed therewithin made complementary respective to a ball 82 formed rearwardly of face 78 of member 74. Numeral 75 indicates the longitudinal axial centerline of the two members 72 and 74.

As seen in FIG. 17, members 72 and 74 have been joined together, with ball 82 being received within ball socket 80. The two members 72 and 74 preferably are joined together by welding, as indicated by numeral 84. The member 74 can be axially rotated about longitudinal centerline 75 and respective to member 72, thereby positioning pocket 50 so that the digging tooth 20 is aligned along any desired, predetermined plane.

Figure 18:
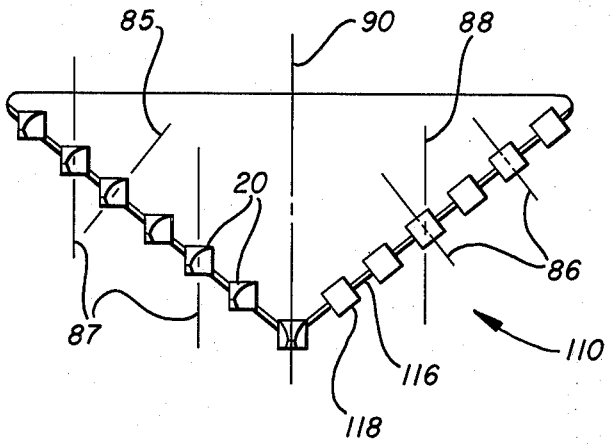
FIG. 18 is a diagrammatical representation of a bucket lip made in accordance with the present invention; and, FIG. 19 is a diagrammatical representation of a front view of another bucket lip made in accordance with the present invention.

In FIG. 18, there is diagrammatically illustrated a front view of a V-shaped bucket 110. The bucket has a lip 116 to which a plurality of shanks 118 have been affixed thereto.

Numerals 85 and 86 indicate a plane which is normally positioned respective to the plane within which the bucket lip is located. Numerals 87 and 88 indicate a vertical plane within which it is desired that the teeth be located. Accordingly, rear shank portion 72 is mounted such that it is oriented along line 85 on the left side of the bucket lip, and along line 86 on the right side of the bucket lip. The pocket member 74 of the shank is aligned along plane 87 on the left side of the bucket lip and along plane 88 on the right side of the bucket lip, thereby bringing the corresponding digging teeth into proper alignment so that any one tooth is oriented in the manner illustrated at 20 in FIG. 15.

Accordingly, the embodiment of the shank illustrated in FIGS. 16 and 17 enables members 72 and 74 to be joined together to provide right hand, left hand, and central shanks, each of which coact with the corresponding digging tooth of the invention to bring the individual teeth into proper aligned relationship respective to the digging action of the bucket and the ditch being excavated.

Figure 19:
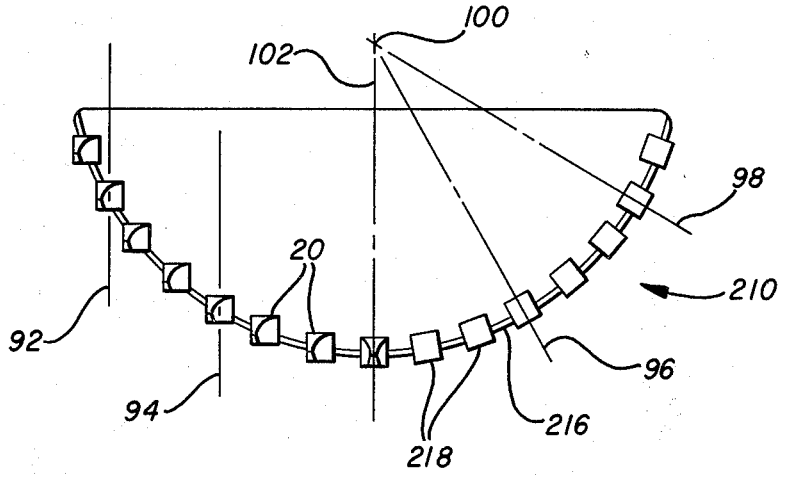

In FIG. 19, there is disclosed a digging bucket 210 having a curved lip 216 in the form of a semicircle. The round bottom bucket of FIG. 19 has shanks 218 arranged thereon which require progressive rotation between members 72 and 74 of FIG. 17, commencing at the central tooth and continuing outwardly towards the outermost teeth on either side of the lip.

Numerals 96 and 98 are different radii drawn from center 100. Plane 102 is a vertical plane which passes through the central tooth. Numerals 92 and 94 are vertical planes placed parallel to plane 102 and indicate the plane in which the digging teeth are oriented to achieve the illustrated tooth position indicated at 20 in FIGS. 15, 18, and 19.

In the embodiment of the invention disclosed in FIGS. 1–15, the shanks 18 located on one side of the bucket lip are mirror images of the shanks located on the other side of the bucket lip, and the central shank preferably is made symmetrical. This enables the digging tooth located at 120 to be positioned in the illustrated manner of FIGS. 2 and 4, while the teeth 20 located at 220 and 320 are properly aligned for optimum digging efficiency in the illustrated manner of FIG. 15.

The symmetrical tooth at 120 has a face 40 formed on either side thereof, thereby presenting a cutting edge 41, 42 on side 38, as well as side 37 of the digging member.

Alternatively, two shanks may be centrally located and a right and left-hand tooth 200 and 320 can be mounted with the sides 38 abutting one another. A single central shank having dual, horizontally spaced pockets may be employed at 120 so that the right and left-hand teeth cooperate together to provide a tooth configuration having a cutting edge on either side thereof.

The shanks preferably are welded to the bucket lip in the manner of FIG. 10. The teeth are mounted within the shanks as disclosed in FIGS. 2, 3, and 10; with a pin being inserted at aperture 33' so that the tooth is releasably held within the shank.

The digging teeth located on either side of the central tooth are selected so that the cutting edges 41 and 42 formed by face 40 lie oriented towards the central tooth. The teeth 200 are similarly arranged respective to one another and to the central tooth. Accordingly, the teeth and shanks located on one side of the bucket lip are mirror images of the teeth and shanks located on the other side of the bucket lip.

As seen in FIG. 15, in conjunction with other figures of the drawings, side 38 of the digging tooth abuttingly engages sidewall 70' of a ledge, with the cutting edges 41 and 42 engaging and removing material from the floor 70 of the ledge. As the cutting edges 41, 42 of the teeth engage and remove material, the material is forced upwardly and inwardly and into the interior of the bucket.

In the embodiment of FIGS. 16 and 17, the pocket member of the shank can be axially rotated about the indicated longitudinal extending axis 75, so that the digging tooth 20 can be oriented in an infinite number of different positions. Accordingly, by the use of the embodiment disclosed in FIGS. 16 and 17, a single shank can be employed to orient the teeth according to the various different positions indicated in FIGS. 4, 18, and 19.

I claim:

1. Digging bucket having a lip at the leading edge thereof and a plurality of shanks by which a plurality of digging teeth are mounted to said lip, there being a shank for each tooth; the improvement comprising:

said teeth include a forward ground engaging end and a rear end, said shanks having a forward marginal end member, means at said rear end by which said tooth is removably attached to the forward marginal end member of said shank;

said lip having opposed sides which extend laterally across the bucket and which are inclined respective to one another so that the teeth located on one side of the lip must be axially rotated along the longitudinal axis thereof respective to the teeth located on the other side of the lip, so that the ground engaging end of the teeth are properly oriented respective to the bucket lip;

said shank includes a rear marginal end member which is attached to said bucket lip, said forward marginal end member of said shank can be axially rotated along the longitudinal axis thereof respective to said rear marginal end member and welded to said rear marginal end member to orient the teeth in any desired direction respective to the bucket lip.

2. The improvement of claim 1 wherein said rear marginal end member and said forward marginal end member of said shank are joined together by a ball and socket, with the ball being formed within one of the shank members and the socket being formed within the other of the shank members; so that the shank members may be joined together in aligned relationship by said ball and socket, and welded together with the forward marginal end member being oriented respective to the bucket lip to cause the ground engaging end of the teeth to properly engage the ground.

3. The improvement of claim 2 wherein said bucket lip is U-shaped when viewed from the digging end of the bucket.

4. The improvement of claim 2 wherein said bucket lip is V-shaped when viewed from the digging end of the bucket.

5. Digging bucket having a lip at the leading edge thereof, said lip is attached to the sidewalls of the bucket and slopes downward towards the center of the bucket; a plurality of tooth-receiving shanks affixed to said lip; each shank having a digging tooth removably received within a pocket of each said shank, the improvement comprising:

said digging tooth having a rearwardly directed tang and a forwardly directed digging member, the digging member of said tooth having opposed sides, a top, and a bottom; said digging member being reduced in cross-sectional area to form a shoulder between said tang and said digging member;

said digging member having a sloped face which slopes upwardly and rearwardly, commencing at the lower end of one sidewall and terminating in spaced relationship respective to the upper end of the opposed sidewall, thereby forming a cutting edge at said lower end of one sidewall, and causing the digging teeth to be progressively reduced in cross-sectional area towards the forward end of the tooth;

said tang being in the form of a polygon in cross-sectional area;

said shank having a forward marginal end member and a rear marginal end member, said pocket being formed in the forward marginal end member of said shank, said pocket receives said tang in close tolerance relationship therewithin; said rear marginal end member of said shank having an upper and lower ledge spaced from one another to form a slot within which the bucket lip is received;

said pocket of said shank is formed into said forward marginal end member, said forward marginal end member is axially rotatable along the longitudinal centerline of the shank so that the forward marginal end member can be welded to the rear marginal end member in a position to cause the teeth to be oriented in any selected direction respective to the bucket.

6. The improvement of claim 5 wherein there are a plurality of shanks on each side of the lip; the teeth on one side of the lip being mirror images of the teeth on the other side of the lip;

said sloped face of the teeth on either side of the bucket lip being upwardly, outwardly, and rearwardly sloped.

7. The improvement of claim 5 wherein the shanks located on one side of the bucket lip are mirror images of the shanks located on the other side of the bucket lip.

8. The improvement of claim 5 wherein the teeth have parallel opposed sides, with said sloped face being formed in a marginal forward part of one side and the top.

9. The improvement of claim 5 wherein said tang is rectangular in cross-sectional area and terminates in a rear wall, said shoulder of the tooth abuttingly engages the forward terminal end of the shank, said pocket having a rear wall which abuttingly engages the rear wall of the tang.

10. The improvement of claim 5 wherein said lip is in the form of a V, and there are a plurality of shanks on each side of the V lip; the teeth on one side of the V being mirror images of the teeth on the other side of the V;

said sloped face of the teeth on one side of the bucket lip being downwardly, inwardly, and rearwardly sloped;

wherein the shanks on one side of the bucket are mirror images of the shanks located on the other side of the bucket.

11. Digging bucket having opposed sidewalls and a lip at the leading edge thereof with a plurality of digging teeth being mounted thereto by a plurality of shanks, the improvement comprising:

each of said teeth include a mount means formed at the rear marginal end thereof and a ground-engaging member formed at the forward marginal end thereof, said ground-engaging member reduces in cross-sectional area at said mount means to form a shoulder, said ground-engaging member includes a sloped face at the forward marginal end portion thereof which defines a cutting edge at the lower, forward marginal end thereof;

said shanks each have a forward marginal end within which a pocket is formed, said pocket being of a configuration to receive said mount means in close tolerance relationship therewithin; a rear marginal end of each of said shanks is in the form of spaced upper and lower ledges joined together to form a lip-receiving slot;

the bucket lip includes opposed marginal lip sides which downwardly slope from attached relationship respective to the bucket sidewalls into attached relationship respective to one another; wherein there are a plurality of said shanks on each lip side; the teeth on one lip side being mirror images of the teeth on the opposed lip side;

said sloped face of the teeth located on either lip side being upwardly, outwardly, and rearwardly sloped.

12. The improvement of claim 11 wherein said lip is in the form of a V; wherein the shanks on one lip side of the bucket are mirror images of the shanks located on the other lip side of the bucket.

13. The improvement of claim 12 wherein the teeth have parallel opposed sides, with said sloped face being formed in a marginal forward part of one side and the top.

14. The improvement of claim 11 wherein said mount means of said teeth is in the form of a tang which is rectangular in cross-sectional area, and terminates in a rear wall, said shoulder of the teeth abuttingly engages the forward terminal end of the shank, said pocket having a rear wall which abuttingly engages the rear wall of the tang.

15. The improvement of claim 11 wherein each said shank includes a rear marginal end member and said forward marginal end within which said pocket is formed; said forward marginal end is axially rotatable along the longitudinal centerline of the shank so that the forward marginal end can be welded to the rear marginal end member in a position to cause the teeth to be oriented in any selected direction respective to the bucket.

* * * * *